US008699925B2

(12) United States Patent
Kashimoto et al.

(10) Patent No.: US 8,699,925 B2
(45) Date of Patent: Apr. 15, 2014

(54) DEVELOPING DEVICE AND IMAGE FORMING APPARATUS INCLUDING THE SAME

(75) Inventors: Masahiro Kashimoto, Osaka (JP); Ryoji Nishimura, Osaka (JP); Hiroaki Ohashi, Osaka (JP); Koji Izumi, Osaka (JP); Takeshi Fujimura, Osaka (JP); Chisato Hatakeyama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 78 days.

(21) Appl. No.: 13/353,617

(22) Filed: Jan. 19, 2012

(65) Prior Publication Data

US 2012/0201575 A1 Aug. 9, 2012

(30) Foreign Application Priority Data

| | | |
|---|---|---|
| Feb. 4, 2011 | (JP) | 2011-023168 |
| Mar. 15, 2011 | (JP) | 2011-056184 |
| Mar. 15, 2011 | (JP) | 2011-056185 |
| Mar. 15, 2011 | (JP) | 2011-056680 |

(51) Int. Cl.
*G03G 15/09* (2006.01)

(52) U.S. Cl.
USPC ..... 399/272; 399/273; 399/274

(58) Field of Classification Search
USPC ..... 399/272, 273, 274
See application file for complete search history.

(56) References Cited

U.S. PATENT DOCUMENTS

| | | | | |
|---|---|---|---|---|
| 4,033,293 | A * | 7/1977 | Ohmori et al. | 399/98 |
| 4,044,719 | A * | 8/1977 | Ohmori | 399/255 |
| 2002/0018672 | A1* | 2/2002 | Ozawa et al. | 399/270 |

FOREIGN PATENT DOCUMENTS

| | | | | |
|---|---|---|---|---|
| JP | S61-033053 A | | 2/1986 | |
| JP | 05-088537 | | 4/1993 | |
| JP | 08-202143 | | 8/1996 | |
| JP | 2005-099239 | | 4/2005 | |
| JP | 2006-058355 | | 3/2006 | |
| JP | 2006-058355 A | * | 3/2006 | G03G 15/09 |
| JP | 2009-047868 | | 3/2009 | |
| JP | 2009-047868 A | * | 3/2009 | G03G 15/08 |
| JP | 2009-93032 | | 4/2009 | |
| JP | 2009-122509 | | 6/2009 | |
| JP | 2010-072013 A | | 4/2010 | |
| JP | 2010-276954 | | 12/2010 | |

OTHER PUBLICATIONS

Extended European Search Report dated May 21, 2012 for corresponding patent No. 12153897.9.

* cited by examiner

*Primary Examiner* — Clayton E LaBalle
*Assistant Examiner* — Jas Sanghera
(74) *Attorney, Agent, or Firm* — Morgan, Lewis & Bockius LLP

(57) ABSTRACT

A developing device includes a developing roller, toner supplying roller, regulation blade, and casing. The developing roller faces an image carrier on which an electrostatic latent image is to be formed, and supplies toner to the image carrier. The toner supplying roller faces the developing roller, and supplies the toner to the developing roller. The regulation blade faces the toner supplying roller at predetermined distance. The casing houses the developing roller, toner supplying roller, and regulation blade. The casing includes a toner catching support member facing the developing roller or the toner supplying roller between the regulation blade and the image carrier. The developing device further includes a toner catching member, which is arranged along a longitudinal direction of the toner catching support member and catches toner that drops from the developing roller, and a vibration generating portion, which vibrates the toner catching member.

15 Claims, 11 Drawing Sheets

DEVELOPING DEVICE AND IMAGE FORMING APPARATUS INCLUDING THE SAME

INCORPORATION BY REFERENCE

This application is based upon and claims the benefit of priority from the corresponding Japanese Patent Application No. 2011-023168 filed on Feb. 4, 2011, 2011-056184 filed on Mar. 15, 2011, 2011-056185 filed on Mar. 15, 2011, and 2011-056680 filed on Mar. 15, 2011, the entire contents of which are incorporated herein by reference.

BACKGROUND

The present disclosure relates to a developing device for supplying a developer to an image carrier and an electrophotographic image forming apparatus including the developing device.

In the electrophotographic image forming apparatus, an electrostatic latent image is formed by applying light based on image information read from an original-document image or on image information transmitted from an external device such as a computer with respect to a peripheral surface of an image carrier (photosensitive drum), and a toner image is formed by supplying toner from a developing device to the electrostatic latent image. After that, the toner image is transferred onto a paper sheet. The paper sheet after the transfer process undergoes a toner-image fixing process, and then is delivered to an outside.

By the way, in recent years, in image forming apparatuses, an apparatus structure has become more complicated in accordance with a transition to color printing and an increase in processing speed. In addition, in order to cope with the increase in processing speed, it is inevitable to rotate a toner stirring member in the developing device at high speed. In particular, in a developing method using a two-component developer containing magnetic carrier and toner, and using a magnetic roller (toner supplying roller) for carrying the developer and a developing roller for carrying only the toner, at a facing portion of the developing roller and the magnetic roller, only the toner is carried onto the developing roller by a magnetic brush formed on the magnetic roller, and further, toner that has not been used for development is peeled off from the developing roller. Therefore, suspension of toner is liable to occur in a vicinity of the facing portion of the developing roller and the magnetic roller. As a result, the suspended toner is deposited around an ear-cutting blade (regulation blade). When the deposited toner is aggregated and adheres to the developing roller, toner dropping may occur and cause image failures.

As a countermeasure, for example, there has been well-known the following developing device using a two-component developer containing magnetic carrier and toner, and using a magnetic roller for carrying the developer and a developing roller for carrying only the toner. That is, an air inlet hole for taking-in air from an outside of the developing device is provided through a wall portion facing the developing roller and the magnetic roller of a developing container, to thereby generate an airflow for causing the suspended toner around the ear-cutting blade to move upward.

Further, there has been well-known a developing device in which a thin plate is arranged between the developing roller and the toner supplying/collecting roller, the thin plate is brought into contact with the toner supplying/collecting roller through intermediation of a nonconductive member, and toner captured on the thin plate is collected onto the toner supplying/collecting roller by vibrating the thin plate and applying an alternating current.

Still further, there has been well-known a developing device including vibration means for vibrating an upper part of the developing roller in a frame body of the developing device. Yet further, there has been well-known a developing device including vibration means for vibrating a guide member for transporting a developer from the magnetic roller to the developing roller.

SUMMARY

The present disclosure has an object to provide a developing device capable of effectively suppressing toner deposition in a casing and an image forming apparatus including the developing device.

According to an aspect of the present disclosure, a developing device includes a developing roller, a toner supplying roller, a regulation blade, and a casing. The developing roller is arranged to face an image carrier on which an electrostatic latent image is to be formed, and supplies toner to the image carrier in a facing region with respect to the image carrier. The toner supplying roller is arranged to face the developing roller, and supplies the toner to the developing roller in a facing region with respect to the developing roller. The regulation blade is arranged to face the toner supplying roller at predetermined distance. The casing houses the developing roller, the toner supplying roller, and the regulation blade. The casing includes a toner catching support member facing the developing roller or the toner supplying roller between the regulation blade and the image carrier. The developing device further includes a toner catching member and vibration generating means. The toner catching member is arranged along a longitudinal direction of the toner catching support member, and catches toner which drops from the developing roller. The vibration generating means vibrates the toner catching member.

Further features and advantages of the present disclosure will become apparent from the description of an embodiment given below.

DETAILED DESCRIPTION

Figure 1:
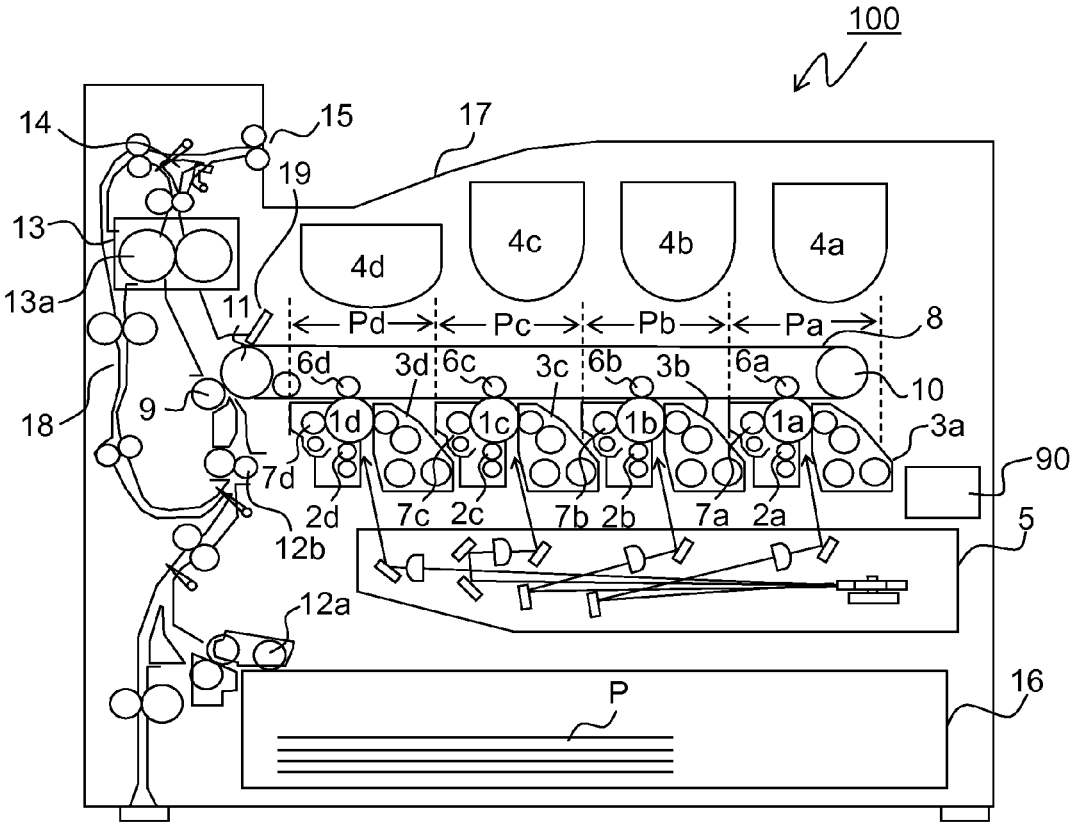
FIG. 1 is a schematic structural view of an image forming apparatus 100 provided with developing devices 3*a* to 3*d* of the present disclosure.

In the following, embodiments of the present disclosure are described with reference to the drawings. FIG. 1 is a schematic sectional view of an image forming apparatus 100 in which developing devices 3*a* to 3*d* of the present disclosure are mounted, and here illustrates a tandem-type color image forming apparatus. In a main body of a color printer 100, four image forming sections Pa, Pb, Pc, and Pd are provided in the stated order from the upstream side in a transporting direction (right side in FIG. 1). The image forming sections Pa to Pd are provided so as to correspond to images of four different colors (cyan, magenta, yellow, and black), and respectively form the images of cyan, magenta, yellow, and black sequentially by respective steps of charging, exposing, developing, and transferring.

In the image forming sections Pa to Pd, there are respectively disposed photosensitive drums 1*a*, 1*b*, 1*c*, and 1*d* for bearing visible images (toner images) of respective colors, and an intermediate transfer belt 8 which is rotated by drive means (not shown) clockwise in FIG. 1 is provided adjacent to the respective image forming sections Pa to Pd. The toner images formed on those photosensitive drums 1*a* to 1*d* are sequentially primarily transferred onto the intermediate transfer belt 8 moving in abutment with the respective photosensitive drums 1*a* to 1*d* so as to be superimposed one on another. After that the toner images which have been primarily transferred onto the intermediate transfer belt 8 are secondarily transferred onto a transfer paper sheet P being an example of a recording medium by action of a secondary transfer roller 9. In addition, the toner images which have been secondarily transferred onto the transfer paper sheet P are fixed at a fixing portion 13, and are then delivered from the main body of the color printer 100. An image forming process is executed on the respective photosensitive drums 1*a* to 1*d* while the photosensitive drums 1*a* to 1*d* are rotated counterclockwise in FIG. 1.

The transfer paper sheet P onto which the toner images are to be secondarily transferred is received within a sheet cassette 16 arranged in a lower portion of the main body of the color printer 100, and is transported via a sheet feeding roller 12*a* and a registration roller pair 12*b* to a nip portion formed between the secondary transfer roller 9 and a drive roller 11 of the intermediate transfer belt 8 described later. A sheet made of a dielectric resin is used for the intermediate transfer belt 8, and a (seamless) belt having no seam is mainly used. Further, a blade-like belt cleaner 19 for removing the toner and the like remaining on a surface of the intermediate transfer belt 8 is arranged on a downstream side of the secondary transfer roller 9.

Next, the image forming sections Pa to Pd are described. Around and below the rotatably disposed photosensitive drums 1*a* to 1*d*, there are provided: chargers 2*a*, 2*b*, 2*c*, and 2*d* for charging the photosensitive drums 1*a* to 1*d*, respectively; an exposure device 5 for performing exposure based on image information with respect to the respective photosensitive drums 1*a* to 1*d*; developing devices 3*a*, 3*b*, 3*c*, and 3*d* for forming toner images on the photosensitive drums 1*a* to 1*d*, respectively; and cleaning portions 7*a*, 7*b*, 7*c*, and 7*d* for removing developers (toner) and the like remaining on the photosensitive drums 1*a* to 1*d*, respectively.

When image data is input from a host apparatus such as a personal computer, the chargers 2*a* to 2*d* first charge surfaces of the photosensitive drums 1*a* to 1*d* uniformly, and then the exposure device 5 applies light correspondingly to the image data to form electrostatic latent images corresponding to the image data on the respective photosensitive drums 1*a* to 1*d*. The developing devices 3*a* to 3*d* are filled with predetermined amounts of two-component developers containing toner of the respective colors, that is, cyan, magenta, yellow, and black, respectively. Note that, the respective developing devices 3*a* to 3*d* are replenished with toner from respective toner containers (replenishing means) 4*a* to 4*d* in a case where the proportion of toner within the two-component developers filling the respective developing devices 3*a* to 3*d* falls below a preset value because of formation of the toner images described below. The toner within the developers is supplied onto the photosensitive drums 1*a* to 1*d* by the developing devices 3*a* to 3*d*. Then, the toner electrostatically adheres to the respective photosensitive drums 1*a* to 1*d*, and thus the toner images, which correspond to the electrostatic latent images formed by the exposure performed by the exposure device 5, are formed on the photosensitive drums 1*a* to 1*d*.

Further, by primary transfer rollers 6*a* to 6*d*, an electric field is applied at a predetermined transfer voltage between the primary transfer rollers 6*a* to 6*d* and the photosensitive drums 1*a* to 1*d*, and the toner images of cyan, magenta, yellow, and black on the photosensitive drums 1*a* to 1*d* are primarily transferred onto the intermediate transfer belt 8. The toner images of four colors are formed to have a predetermined positional relationship that is previously defined for forming a predetermined full-color image. After that, in preparation for the formation of new electrostatic latent images to be subsequently performed, the toner and the like remaining on the surfaces of the photosensitive drums 1*a* to 1*d* after the primarily transfer are removed by the cleaning portions 7*a* to 7*d*, respectively.

The intermediate transfer belt 8 is stretched around a driven roller 10 on an upstream side thereof and the drive roller 11 on a downstream side thereof When the intermediate transfer belt 8 starts to rotate clockwise in accordance with the rotation of the drive roller 11 caused by a drive motor (not shown), the transfer paper sheet P is transported from the registration roller pair 12*b* at a predetermined timing to a nip portion (secondary transfer nip portion) between the drive roller 11 and the secondary transfer roller 9 provided adjacent thereto, and a full-color toner image on the intermediate transfer belt 8 is secondarily transferred onto the transfer paper sheet P. The transfer paper sheet P onto which the toner image has been secondarily transferred is transported to the fixing portion 13.

The transfer paper sheet P transported to the fixing portion 13 is heated and pressurized by a fixing roller pair 13*a*, and the toner images are fixed to a surface of the transfer paper sheet P to form a predetermined full-color image. The transfer paper sheet P on which the full-color image has been formed is directed toward one of a plurality of transporting directions branched from a branch portion 14. In a case where an image is formed on only one surface of the transfer paper sheet P, the transfer paper sheet P is delivered to a delivery tray 17 by delivery rollers 15 as it is.

On the other hand, in a case where images are formed on both surfaces of the transfer paper sheet P, the transfer paper sheet P that has passed through the fixing portion 13 is temporarily transported toward the delivery rollers 15. Then, after a trailing end of the transfer paper sheet P passes through the branch portion 14, the delivery rollers 15 are rotated reversely, and a transporting direction of the branch portion 14 is switched. Thus, the transfer paper sheet P has the trailing end directed toward a sheet transport path 18, and is again transported to the secondary transfer nip portion under a state in which an image surface is reversed. Then, the next toner image formed on the intermediate transfer belt 8 is secondarily transferred by the secondary transfer roller 9 onto a surface of the transfer paper sheet P on which no image is formed. Then, the transfer paper sheet P onto which the toner image has been secondarily transferred is transported to the fixing portion 13, and has the toner image fixed thereto, and then is delivered to the delivery tray 17.

Further, an exhaust fan 90 is provided on a rear surface side of the apparatus main body. The exhaust fan 90 exhausts air in the apparatus main body to an outside of the apparatus main body.

Figure 2:
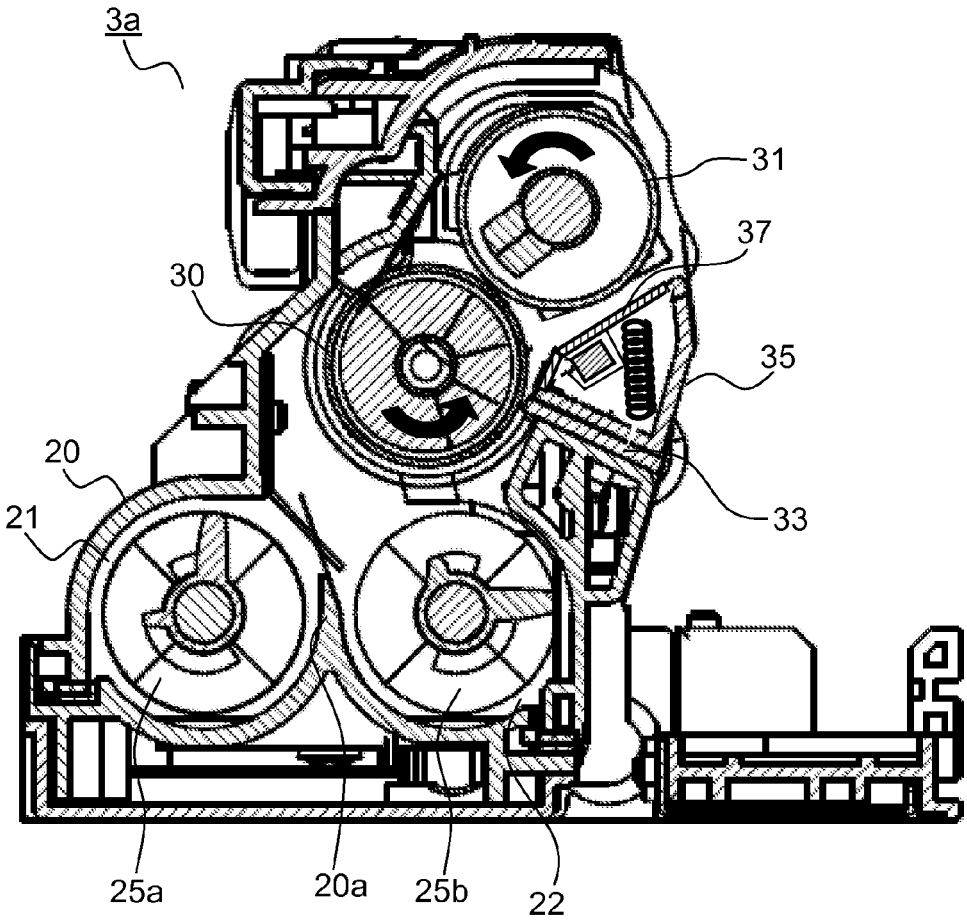
FIG. 2 is a side sectional view of the developing device 3*a* according to a first embodiment of the present disclosure.

FIG. 2 is a schematic side sectional view of the developing device 3*a* according to a first embodiment of the present disclosure. Note that, FIG. 2 illustrates a state in which the developing device 3*a* is viewed from the rear surface side of FIG. 1, and arrangement of the components in the developing device 3*a* is left-right reversal to that of FIG. 1. Further, in the following description, only the developing device 3*a* arranged at the image forming section Pa of FIG. 1 is exemplified, and the developing devices 3*b* to 3*d* arranged at the image forming sections Pb to Pd are not described. This is because each of the developing devices 3*b* to 3*d* has basically the same structure as that of the developing device 3*a*.

As illustrated in FIG. 2, the developing device 3*a* includes a developing container (casing) 20 for storing the two-component developer (hereinafter, simply referred to as developer), and the developing container 20 is partitioned by a partition wall 20*a* into a stirring-and-transporting chamber 21 and a supplying-and-transporting chamber 22. In the stirring-and-transporting chamber 21 and the supplying-and-transporting chamber 22, there are respectively and rotatably disposed a stirring-and-transporting screw 25*a* and a supplying-and-transporting screw 25*b* for mixing and stirring toner (positively charged toner) to be supplied from the toner container 4*a* (refer to FIG. 1) with carrier so that the toner is charged.

The developer is transported in an axial direction (direction perpendicular to the drawing sheet of FIG. 2) while being stirred by the stirring-and-transporting screw 25*a* and the supplying-and-transporting screw 25*b*, and circulates between the stirring-and-transporting chamber 21 and the supplying-and-transporting chamber 22 through developer passages (not shown) formed at both end portions of the partition wall 20*a*. In other words, a developer circulation path is formed of the stirring-and-transporting chamber 21, the supplying-and-transporting chamber 22, and the developer passages in the developing container 20.

The developing container 20 extends obliquely right upward in FIG. 2. In the developing container 20, a toner supplying roller 30 is arranged above the supplying-and-transporting screw 25*b*, and a developing roller 31 is arranged obliquely right above the toner supplying roller 30 in a manner of facing the toner supplying roller 30. The developing roller 31 faces the photosensitive drum 1*a* (refer to FIG. 1) on an opening side of the developing container 20 (right side of FIG. 2). The toner supplying roller 30 and the developing roller 31 are rotated counterclockwise in FIG. 2 about rotary shafts thereof.

In the stirring-and-transporting chamber 21, a toner concentration sensor (not shown) is arranged to face the stirring-and-transporting screw 25*a*. Based on detection results from the toner concentration sensor, the stirring-and-transporting chamber 21 is replenished with toner from the toner container 4*a* through a toner replenishing port (not shown). As the toner concentration sensor, for example, there is used a magnetic permeability sensor for detecting a magnetic permeability of the two-component developer constituted by toner and magnetic carrier in the developing container 20.

The toner supplying roller 30 is a magnetic roller formed of a non-magnetic rotary sleeve rotated counterclockwise in FIG. 2, and a fixed magnet body having a plurality of magnetic poles enclosed in the rotary sleeve.

The developing roller 31 is formed of a cylindrical developing sleeve rotated counterclockwise in FIG. 2, and a developing-roller-side magnetic pole fixed in the developing sleeve. The toner supplying roller 30 and the developing roller 31 face each other with a predetermined gap at a facing position. The developing-roller-side magnetic pole has a polarity reverse to that of one of the magnetic poles of the fixed magnet body (main pole), the one being to face the developing-roller-side magnetic pole.

Further, the developing container 20 is provided with an ear-cutting blade 33 (regulation blade) attached along a longitudinal direction of the toner supplying roller 30 (direction perpendicular to the drawing sheet of FIG. 2). In a rotational direction of the toner supplying roller 30 (counterclockwise direction in FIG. 2), the ear-cutting blade 33 is positioned on an upstream side relative to the facing position of the developing roller 31 and the toner supplying roller 30. A slight gap is formed between a distal end portion of the ear-cutting blade 33 and a surface of the toner supplying roller 30.

The developing roller 31 is applied with a direct-current voltage (hereinafter, referred to as Vslv(DC)) and an alternating-current voltage (hereinafter, referred to as Vslv(AC)). The toner supplying roller 30 is applied with a direct-current voltage (hereinafter, referred to as Vmag(DC)) and an alternating-current voltage (hereinafter, referred to as Vmag (AC)). Those direct-current voltages and alternating-current voltages are applied to the developing roller 31 and the toner supplying roller 30 from a developing-bias power source via a bias control circuit (none of which is shown).

As described above, the developer circulates in the stirring-and-transporting chamber 21 and the supplying-and-transporting chamber 22 in the developing container 20 while being stirred by the stirring-and-transporting screw 25*a* and the supplying-and-transporting screw 25*b* so that the toner within the developer is charged. The developer in the supplying-and-transporting chamber 22 is supplied to the toner supplying roller 30 by the supplying-and-transporting screw 25*b*. Then, a magnetic brush (not shown) is formed on the toner supplying roller 30. The magnetic brush on the toner supplying roller 30 is regulated in layer thickness by the ear-cutting blade 33, and then transported by rotation of the toner supplying roller 30 to the facing portion of the toner supplying roller 30 and the developing roller 31. In this way, a toner thin layer is formed on the developing roller 31 with use of a potential difference ΔV between Vmag(DC) to be applied to the toner supplying roller 30 and Vslv(DC) to be applied to the developing roller 31, and a magnetic field.

A toner layer thickness on the developing roller 31 can be controlled with ΔV, although varying depending on resistance of the developer, a difference in rotational speed of the toner supplying roller 30 and the developing roller 31, and the like. The toner layer thickness on the developing roller 31 is increased by increasing ΔV, and decreased by decreasing ΔV. An appropriate range of ΔV at the time of development is generally of from approximately 100 V to 350 V.

Rotation of the developing roller 31 causes the toner thin layer formed on the developing roller 31 by contact with the magnetic brush on the toner supplying roller 30 to be transported to a facing portion (facing region) of the photosensitive drum 1*a* and the developing roller 31. The developing roller 31 is applied with Vslv(DC) and Vslv(AC), and hence potential difference between the developing roller 31 and the photosensitive drum 1*a* causes the toner to fly from the developing roller 31 to the photosensitive drum 1*a*. In this way, the electrostatic latent image on the photosensitive drum 1*a* is developed.

Toner remaining without being used for development is transported again to the facing portion of the developing roller 31 and the toner supplying roller 30, and is collected by the magnetic brush on the toner supplying roller 30. Next, the magnetic brush is peeled off from the toner supplying roller 30 at a portion of the fixed magnet body, at which the polarity of the fixed magnet body is the same, and then drops into the supplying-and-transporting chamber 22.

After that, based on detection results from the toner concentration sensor (not shown), a predetermined amount of toner is replenished from the toner replenishing port (not shown), and becomes a two-component developer uniformly charged again at an appropriate toner concentration during circulation between the supplying-and-transporting chamber 22 and the stirring-and-transporting chamber 21. The developer is supplied again onto the toner supplying roller 30 by the supplying-and-transporting screw 25*b* so as to form the magnetic brush, and transported to the ear-cutting blade 33.

In a vicinity of the developing roller 31 on a right-side wall of the developing container 20 in FIG. 2, there is provided a toner catching support member 35 having a sectional triangular shape, projecting to an inside of the developing container 20. As illustrated in FIG. 2, the toner catching support member 35 is arranged along a longitudinal direction of the developing container 20 (direction perpendicular to the drawing sheet of FIG. 2). An upper surface of the toner catching support member 35 forms a wall portion facing the toner supplying roller 30 and the developing roller 31 and inclined downward in a direction of from the developing roller 31 to the toner supplying roller 30. On the upper surface of the toner catching support member 35, a toner catching member 37 for catching toner to be peeled off and drop from the developing roller 31 is attached along the longitudinal direction.

Figure 3:
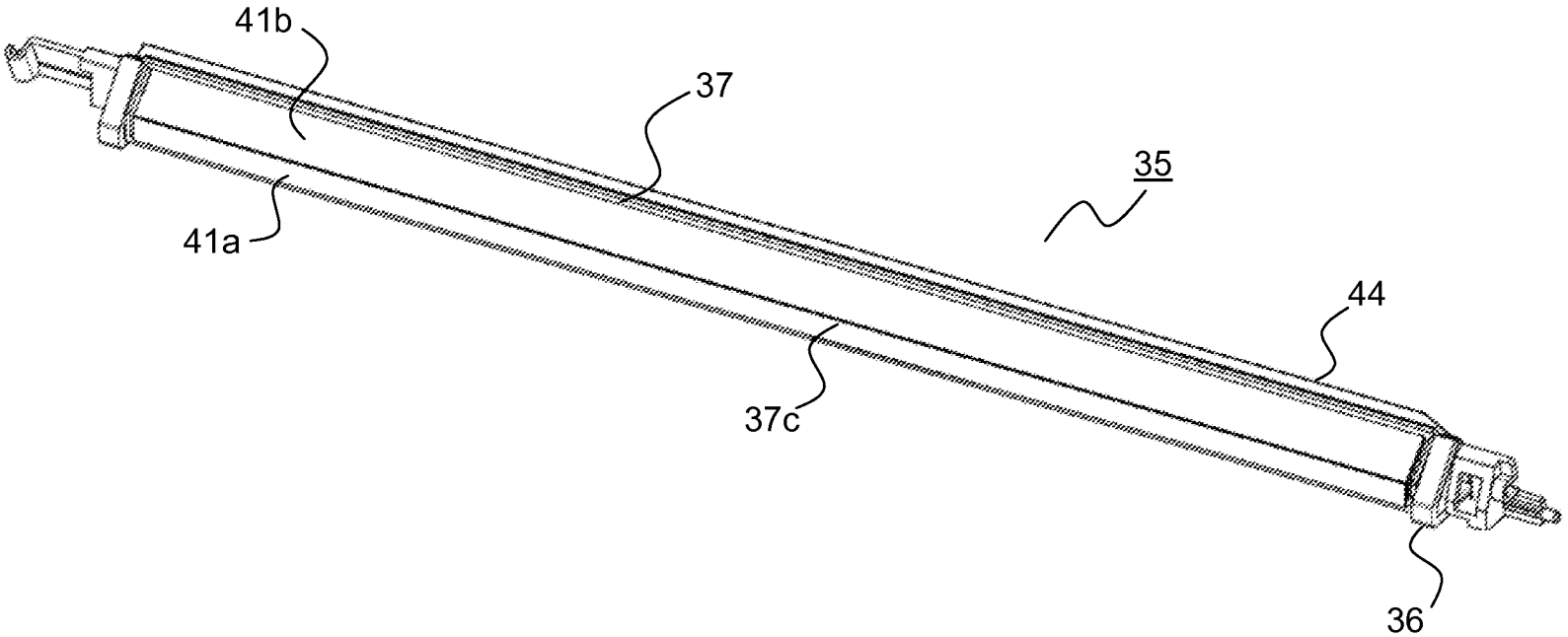
FIG. 3 is a perspective view of a toner catching support member 35 viewed from a developing container 20 side.
Figure 4:
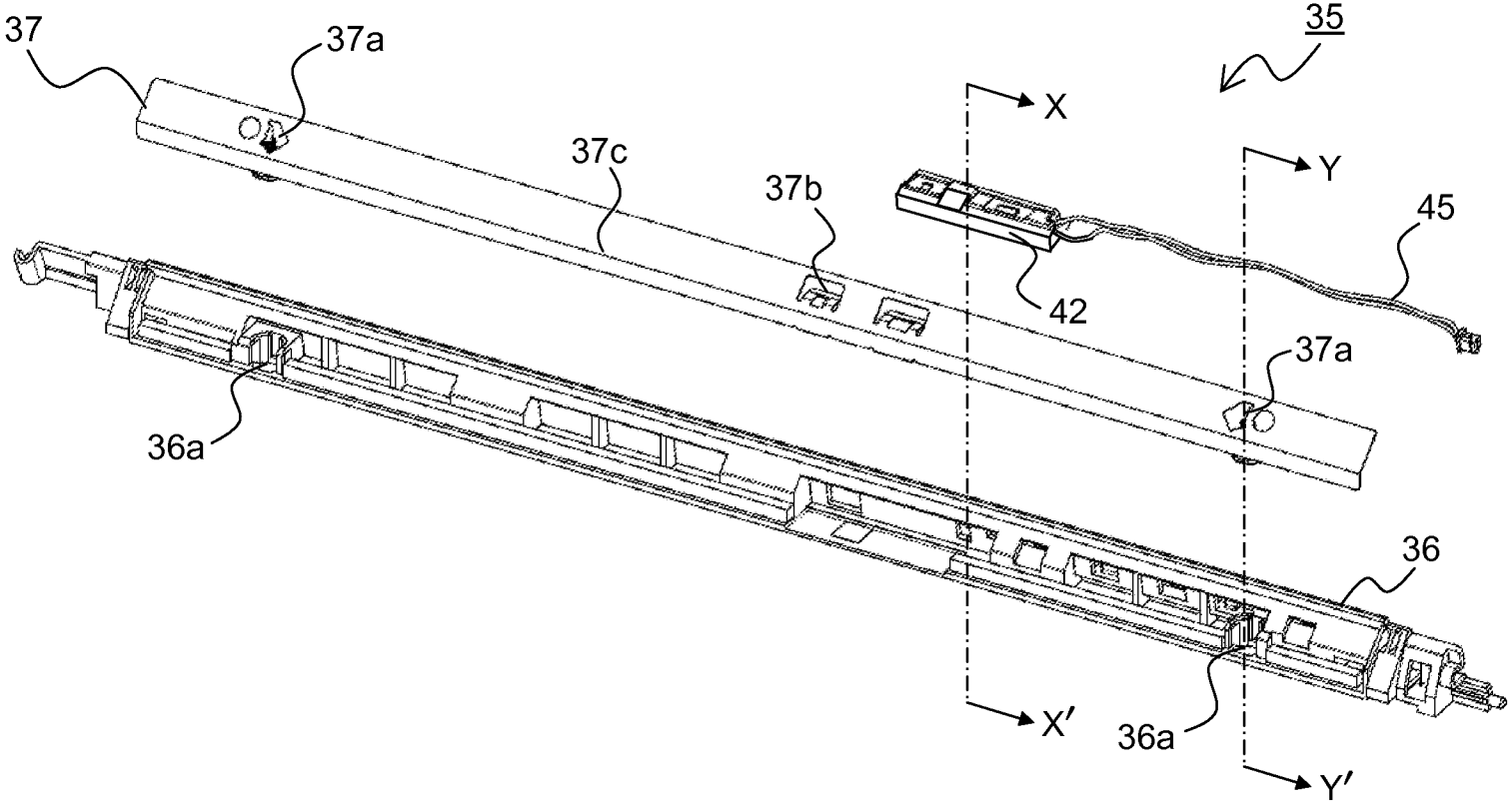
FIG. 4 is an exploded perspective view of the toner catching support member 35.
Figure 5A:
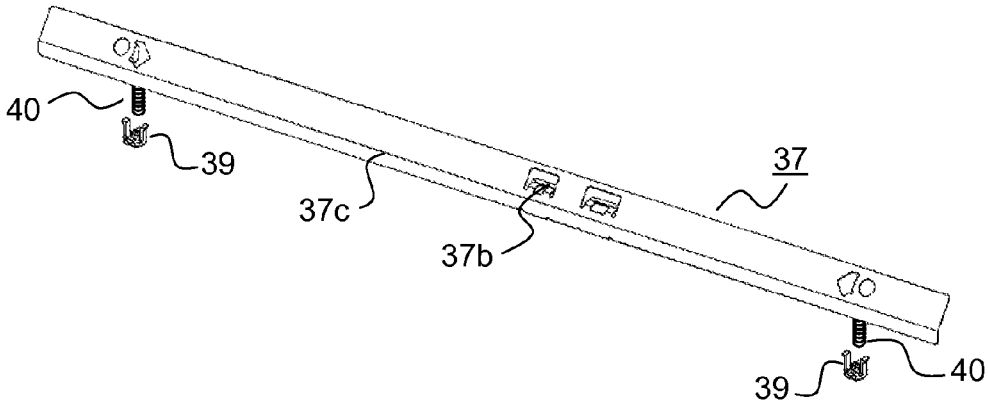
FIG. 5A is an external perspective view of a toner catching member 37.
Figure 5B:
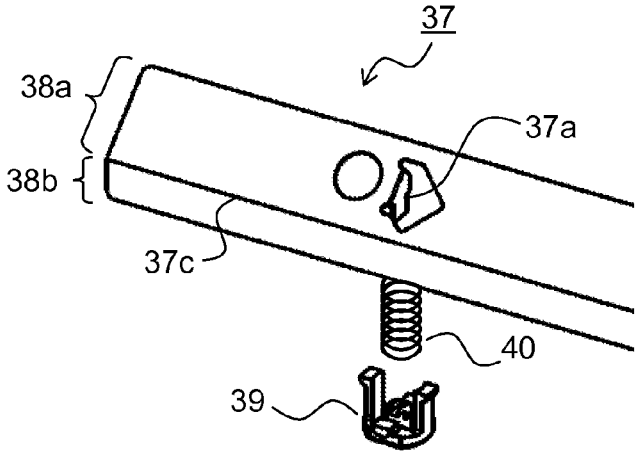
FIG. 5B is an enlarged perspective view illustrating a vicinity of an engaging portion 37*a* of the toner catching member 37.
Figure 6:
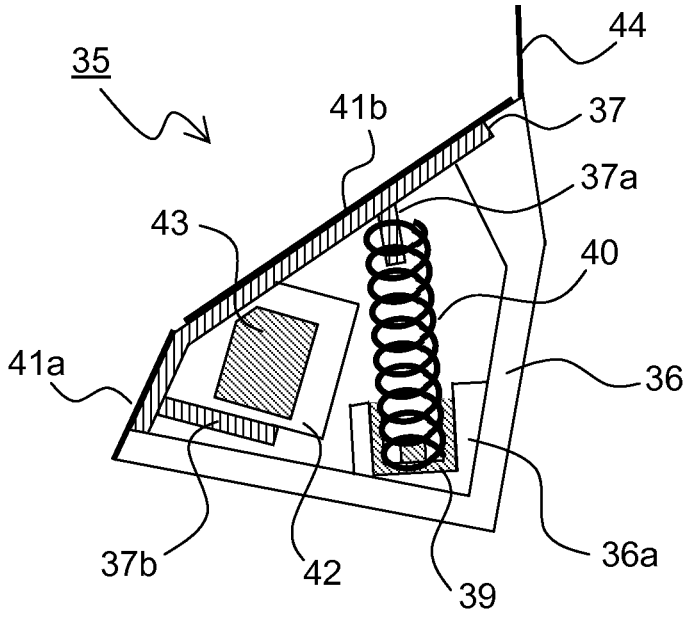
FIG. 6 is a side sectional view of an internal structure of the toner catching support member 35.

FIG. 3 is a perspective view of the toner catching support member 35 viewed from the inside of the developing container 20 (left side of FIG. 2). FIG. 4 is an exploded perspective view of the toner catching support member 35. FIGS. 5A and 5B are an external perspective view and an enlarged perspective view of the toner catching member 37, respectively. FIG. 6 is a side sectional view of an internal structure of the toner catching support member 35. Note that, illustration of sheet members 41*a* and 41*b* is omitted in FIG. 4. Further, FIG. 6 illustrates both a cross-section of a vicinity of a vibration motor 43 of the toner catching support member 35 (cross-section taken along the arrows X-X' of FIG. 4) and a cross-section of a vicinity of a coil spring 40 of the toner catching support member 35 (cross-section taken along the arrows Y-Y' of FIG. 4) in a superimposed manner.

The toner catching member 37 is formed of a metal plate, and supported through intermediation of two coil springs 40 by a support-member main body 36 made of a resin. Specifically, as illustrated in FIGS. 5A and 5B, at two points at both end portions of the toner catching member 37, engaging portions 37*a* with which one ends of the coil springs 40 are to be engaged are formed by bending, and a spring base 39 is mounted to another end of each of the coil springs 40. The spring base 39 is held by a spring-base holding portion 36*a* of the support-member main body 36. Further, a holder holding portion 37*b* for supporting a motor mounting holder 42 is formed by bending at substantially a middle portion of the toner catching member 37.

The vibration motor 43 is fixed to a rear surface of the toner catching member 37 through intermediation of the motor mounting holder 42. Circuits and electronic components (not shown) for controlling drive of the vibration motor 43 are implemented in the motor mounting holder 42, and a lead wire 45 for supplying electric power to the vibration motor 43 is connected to the vibration motor 43.

The sheet members 41*a* and 41*b* are bonded to the surface of the toner catching member 37. In order to suppress toner adhesion to the toner catching member 37, the sheet members 41*a* and 41*b* are made of a material which is less liable to undergo toner adhesion than the toner catching member 37. Examples of the material for the sheet members 41*a* and 41*b* include a fluororesin sheet. The sheet member 41*a* is bonded to cover the surface of the toner catching member 37, the surface including a boundary between the support-member main body 36 on the ear-cutting blade 33 side and the toner catching member 37. Further, the sheet member 41*b* is bonded to cover the surface of the toner catching member 37, the surface including a boundary between the support-member main body 36 on a seal member 44 side and the toner catching member 37, the engaging portion 37*a*, and the holder holding portion 37*b*.

Further, the seal member 44 having a film-like shape is provided at an upper end of the support-member main body 36. The seal member 44 extends in a longitudinal direction of the support-member main body 36 (direction perpendicular to the drawing sheet of FIG. 6) so that a leading end portion of the seal member 44 comes into contact with a surface of the photosensitive drum 1*a*. The seal member 44 has a shutting function so that toner in the developing container 20 (refer to FIG. 2) is prevented from leaking to the outside.

Figure 7:
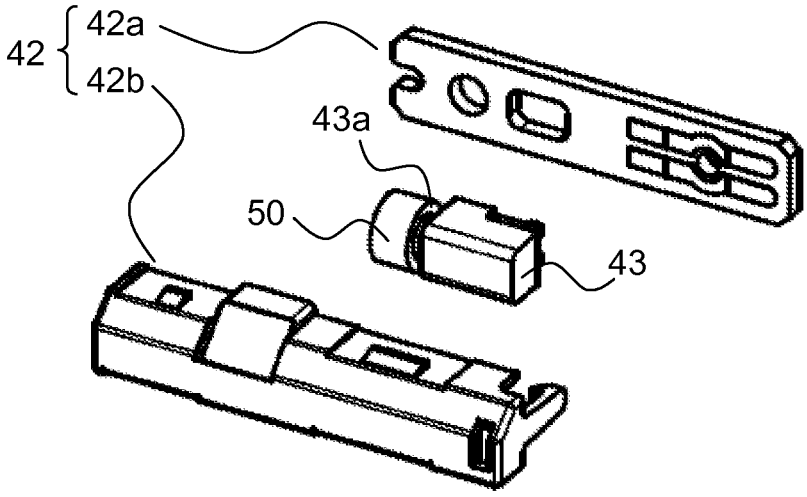
FIG. 7 is an exploded perspective view of a motor mounting holder 42.

FIG. 7 is an exploded perspective view of the motor mounting holder 42 in FIG. 4. The motor mounting holder 42 is formed of a motor mounting plate 42*a* and a cover member 42*b*, the vibration motor 43 being fixed to the motor mounting plate 42*a*. An oscillating weight 50 is fixed to an output shaft 43*a* of the vibration motor 43. Further, the vibration motor 43 is fixed in a manner that the output shaft 43*a* extends along a longitudinal direction of the toner catching member 37.

Figure 8:
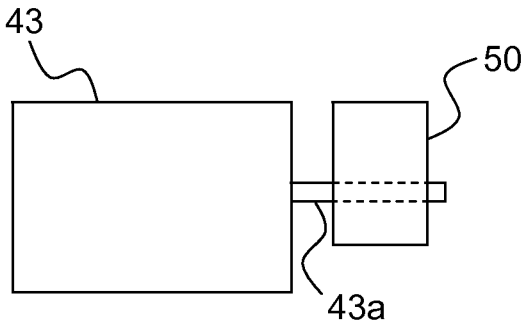
FIG. 8 is a front view of a vibration motor 43.
Figure 9:
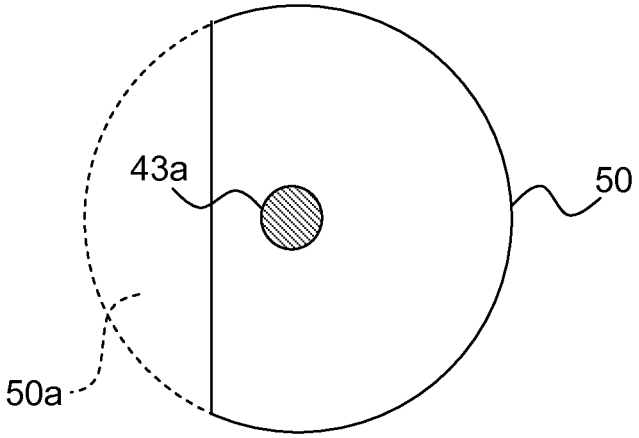
FIG. 9 is a side view of the vibration motor 43 viewed from an oscillating weight 50 side.

FIG. 8 is a front view of the vibration motor 43, and FIG. 9 is a side view of the vibration motor 43 viewed from the oscillating weight 50 side. When being viewed in a direction of the output shaft 43*a* of the vibration motor 43 (right direction of FIG. 8), the oscillating weight 50 exhibits a cam shape, specifically, a shape of a disk plate provided with a cutout portion 50*a* as illustrated in FIG. 9, in other words, a shape asymmetrical with respect to the output shaft 43*a*. When the output shaft 43*a* is rotated at a predetermined speed or higher, a centrifugal force to act on the cutout portion 50*a* is smaller than those on other parts, and hence a non-uniform centrifugal force acts on the oscillating weight 50. When the centrifugal force is transmitted to the output shaft 43*a*, the vibration motor 43 vibrates. Note that, the shape of the oscillating weight 50 is not limited to the cam shape, and any shape may be employed as long as a center of gravity can be shifted with respect to the output shaft 43*a*.

Figure 10:
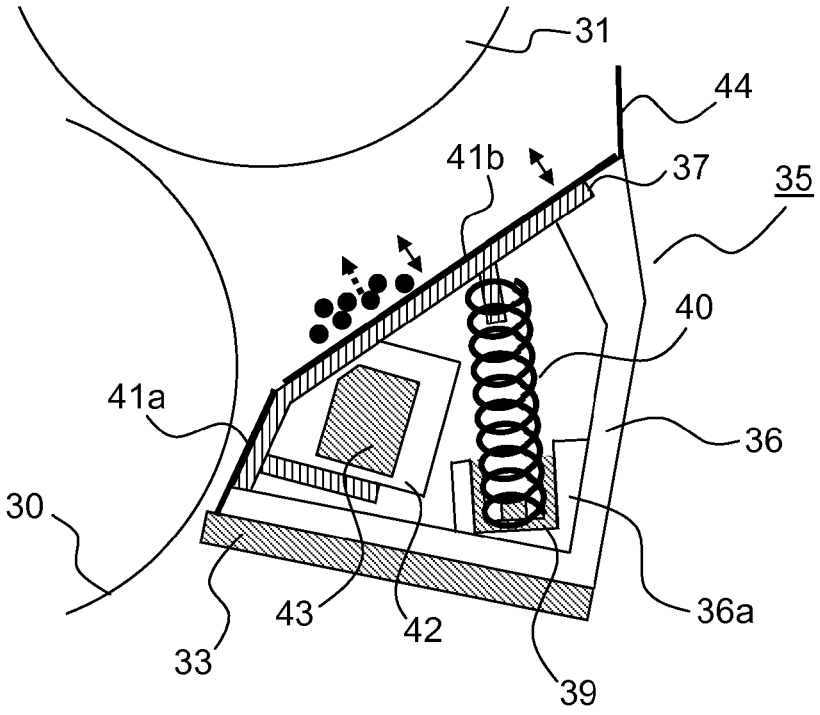
FIG. 10 is a schematic side view illustrating an operation of the toner catching member 37 during drive of the developing device 3*a*.

FIG. 10 is a schematic side view illustrating an operation of the toner catching member 37 during drive of the developing device 3*a*. By rotating the output shaft 43*a* of the vibration motor 43 at high speed (for example, approximately 10,000 rpm) during the drive of the developing device 3*a*, the oscillating weight 50 is rotated at high speed together with the output shaft 43*a*. In this case, a non-uniform centrifugal force acts on the oscillating weight 50, and hence the vibration motor 43 and the motor mounting holder 42 vibrate through intermediation of the output shaft 43*a*. As a result, the toner catching member 37 to which the motor mounting holder 42 is fixed also vibrates.

Vibration of the toner catching member 37 causes the toner deposited on the toner catching member 37 to be separated and shaken off.

In this way, even when a large amount of toner is suspended owing to high-speed rotation of the toner supplying roller 30 and the developing roller 31 in the developing device 3*a*, toner deposition on the toner catching member 37 is suppressed.

In addition, the sheet members 41*a* and 41*b* are bonded to the surface of the toner catching member 37, and hence adhesion of toner to the toner catching member 37 can be suppressed. Further, the sheet members 41*a* and 41*b* are bonded to cover the boundary between the toner catching support member 35 and the toner catching member 37, the engaging portion 37*a*, and the holder holding portion 37*b*. Thus, the following failures are prevented: toner leakage from the boundary between the toner catching support member 35 and the toner catching member 37; toner intrusion into the toner catching support member 35; and operational failures of the vibration motor 43, which are derived from the toner intrusion.

Figure 11:
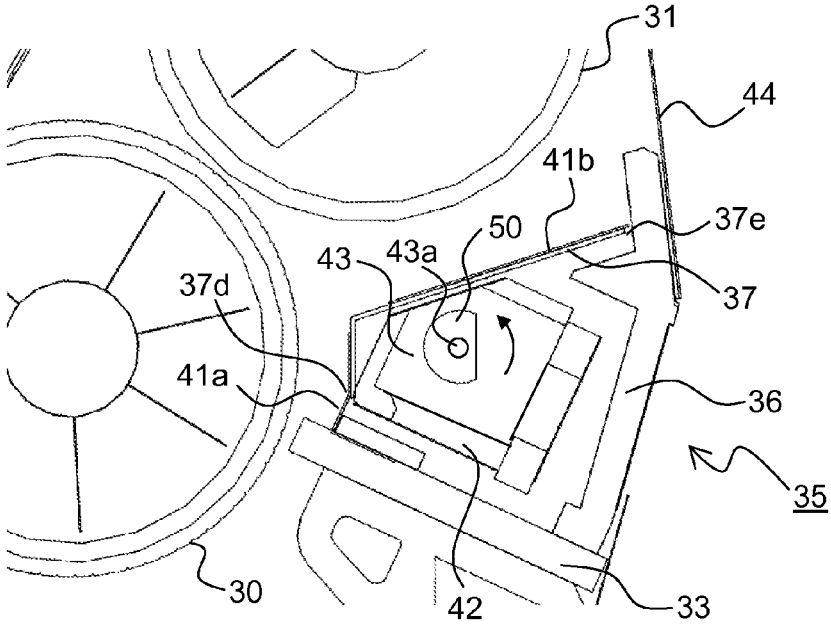
FIG. 11 is a side sectional view illustrating a vicinity of the vibration motor 43 of the toner catching support member 35 used in the developing device 3*a* according to the first embodiment of the present disclosure.
Figure 12:
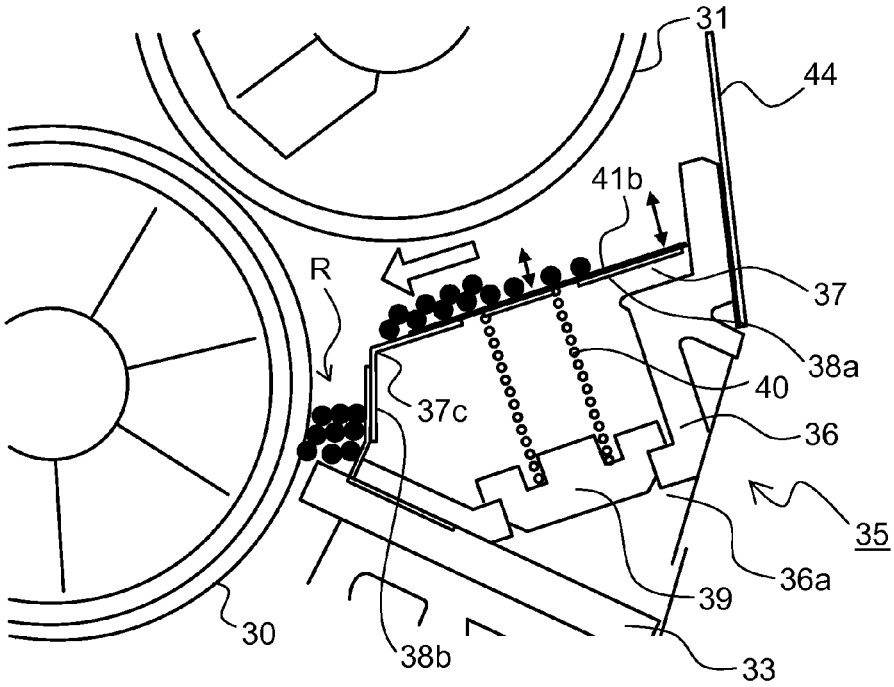
FIG. 12 is a side sectional view illustrating a vicinity of a coil spring 40 of the toner catching support member 35 used in the developing device 3*a* according to the first embodiment of the present disclosure.

FIGS. 11 and 12 are each a side sectional view of the internal structure of the toner catching support member 35 used in the developing device 3*a*. Note that, FIG. 11 illustrates a cross-section of the vicinity of the vibration motor 43 of the toner catching support member 35 (cross-section taken along the arrows X-X' of FIG. 4), and FIG. 12 illustrates a cross-section of the vicinity of the coil spring 40 of the toner catching support member 35 (cross-section taken along the arrows Y-Y' of FIG. 4).

As illustrated in FIGS. 11 and 12, only an edge 37*d* on the toner supplying roller 30 side of the toner catching member 37 is held in abutment with the support-member main body 36, and an edge 37*e* on an opposite side (photosensitive drum 1*a* side) is a free end. A substantially central portion in a width direction (left-right direction in FIG. 12) of a toner catching surface 38*a* is supported through intermediation of the coil spring 40 by the support-member main body 36. With this, the toner catching member 37 is rockable about the edge 37*d* as a fulcrum. Further, the vibration motor 43 is arranged such that the output shaft 43*a* thereof is substantially parallel to the longitudinal direction of the toner catching member 37.

Further, the toner catching member 37 is inclined such that the toner catching surface 38*a* facing the developing roller 31 has a rising gradient from the toner supplying roller 30 side to the photosensitive drum 1*a* side, and is arranged such that a toner dropping surface 38*b* facing the toner supplying roller 30 is substantially perpendicular.

By rotating the output shaft 43*a* at high speed (for example, approximately 10,000 rpm) except during image formation, the oscillating weight 50 is rotated at high speed together with the output shaft 43*a*. In this case, a non-uniform centrifugal force acts on the oscillating weight 50, and hence the vibration motor 43 and the motor mounting holder 42 vibrate through intermediation of the output shaft 43*a*. In accordance therewith, the toner catching member 37 to which the motor mounting holder 42 is fixed also vibrates. Specifically, the toner catching member 37 vibrates with the edge 37*d* as a fulcrum in a manner of increasing amplitude toward the edge 37*e*.

As illustrated in FIG. 12, vibration of the toner catching member 37 causes toner deposited on the toner catching surface 38*a* of the toner catching member 37 to slide off downward along an inclination of the toner catching surface 38*a* (direction of the hollow arrow in FIG. 12), with the result that the toner drops into a region R sandwiched between the toner dropping surface 38*b* and the toner supplying roller 30.

In this embodiment, as illustrated in FIG. 12, the toner catching member 37 is arranged such that the toner dropping surface 38*b* is substantially perpendicular. Thus, the toner in the region R more easily falls.

In this context, in order to return the toner having dropped into the region R toward the supplying-and-transporting chamber 22, it is preferred to rotate, except during the image formation, the toner supplying roller 30 in a direction reverse to that during the image formation (clockwise direction in FIG. 12). By rotating the toner supplying roller 30 in the reverse direction, the toner having dropped and been deposited in the region R trails along the surface of the toner supplying roller 30, and passes through a gap between the toner supplying roller 30 and the ear-cutting blade 33, with the result of being forcibly returned to the supplying-and-transporting chamber 22.

Further, in this embodiment, the output shaft 43*a* of the vibration motor 43 is rotated in a direction in which an outer peripheral surface of the output shaft 43*a*, which is on a side facing the toner catching member 37, moves from the free end (edge 37*e*) toward the fulcrum (edge 37*d*) of the toner catching member 37 (counterclockwise direction in FIG. 11). By rotating the output shaft 43*a* in this direction, the toner catching member 37 vibrates to move toner deposited on the toner catching surface 38*a* from the edge 37*e* side to the edge 37*d* side.

Meanwhile, when the output shaft 43*a* is rotated in a reverse direction (clockwise direction in FIG. 11), toner is moved gradually upward by the vibration of the toner catching member 37 from the edge 37*d* side to the edge 37*e* side, and hence the toner deposited on the toner catching surface 38*a* does not slide off Thus, by rotating the output shaft 43*a* of the vibration motor 43 as described above in this embodiment, the toner deposited on the toner catching surface 38*a* can be effectively dropped into the region R along the descending gradient.

Further, the coil spring 40 is arranged substantially perpendicularly to the toner catching surface 38*a*, and hence an extension/retraction direction of the coil spring 40 and a vibrating direction of the toner catching member 37 substantially correspond to each other. As a result, vibration caused by extension/retraction of the coil spring 40 is efficiently transmitted to the toner catching member 37. Thus, vibration of the toner catching member 37 can be increased, and accordingly, the toner deposited on the toner catching surface 38*a* is more effectively shaken off.

The vibration of the toner catching member 37 and the rotation of the toner supplying roller 30 into the reverse direction may be performed at each completion of a printing operation, or at predetermined timing such as a time point at which a predetermined number of sheets have been printed or a time point at which a predetermined or higher temperature has been detected in the developing device 3*a*. Alternatively, the vibration of the toner catching member 37 and the rotation of the toner supplying roller 30 into the reverse direction may be performed at the same or different timing. Further, when the toner catching member 37 is set to be vibrated every time a predetermined number of sheets have been printed, the toner catching member is automatically vibrated in accordance with the number of printed sheets. Thus, it is unnecessary for a user himself/herself to manually set vibration of the toner catching member 37, and hence setting errors, negligence in setting, and execution of unnecessary vibration can be avoided.

By the way, in comparison with a case of successive printing, toner is more liable to be deposited on the toner catching member 37 in a case of single printing. The reason is considered to be because, in the case of single printing, the rotations of the toner supplying roller 30 and the developing roller 31 are intermittently stopped, and hence an amount of airflow in the developing container 20 is smaller than that in the case of successive printing. Similarly, toner fluidity decreases in a high-temperature and high-humidity environment, and hence toner is more liable to be deposited on the toner catching member 37 in comparison with that in a normal-temperature and normal-humidity environment.

As a countermeasure, in the case of single printing, the vibration motor 43 is activated on a smaller sheet-number basis than that in the case of successive printing. Similarly, in the high-temperature and high-humidity environment, the vibration motor 43 is activated on a smaller sheet-number basis than that in the normal-temperature and normal-humidity environment. In this way, toner deposition on the toner catching member 37 is effectively suppressed.

Figure 13:
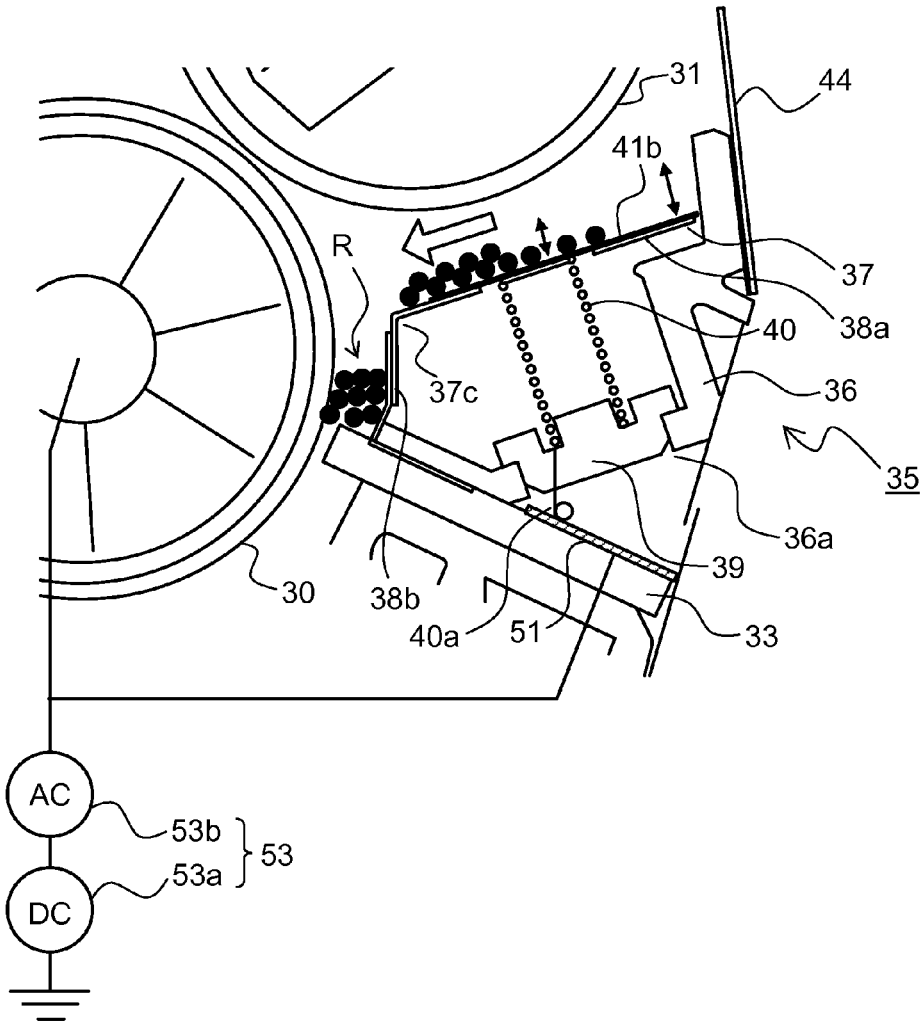
FIG. 13 is a side sectional view of the internal structure of the toner catching support member 35 used in the developing device 3*a* according to a second embodiment of the present disclosure.

FIG. 13 is a side sectional view of the internal structure of the toner catching support member 35 used in the developing device 3*a* according to a second embodiment of the present disclosure. Note that, FIG. 13 illustrates the cross-section of the vicinity of the coil spring 40 of the toner catching support member 35 (cross-section taken along the arrows Y-Y' of FIG. 4). In this embodiment, the one end of the coil spring 40 is extended downward, and a contact 40*a* is formed at a leading end. The contact 40*a* is held in contact with a conductive plate 51, and the conductive plate 51 is electrically connected to a bias power source 53. In other words, the toner catching member 37 is electrically connected to the bias power source 53 through intermediation of the coil spring 40, and has the same potential as that of the toner supplying roller 30. Other structural details are similar to those in the first embodiment illustrated in FIGS. 11 and 12, and hence description thereof is omitted.

According to the structure of this embodiment, by setting the toner supplying roller 30 and the toner catching member 37 to have the same potential, electric current leakage between the toner catching member 37 made of metal and the toner supplying roller 30 is prevented. Further, a bias of the same polarity as that of toner (in this case, positive polarity) is applied to the toner supplying roller 30, and hence the bias of the same polarity as that of toner is applied also to the toner catching member 37. Thus, toner does not electrostatically adhere to the toner catching member 37, and toner deposition onto the toner catching member 37 can be suppressed. Further, electric current leakage between the toner supplying roller 30 and the toner catching member 37 is prevented.

Otherwise, the present disclosure is not limited to the above-mentioned embodiments, and various modifications may be made thereto without departing from the spirit of the present disclosure. For example, the shapes and structures of the toner catching support member 35 and the toner catching member 37 described in the above-mentioned embodiments are merely an example, and hence are not particularly limited to those in the above-mentioned embodiments. The shapes and structures can be appropriately configured in accordance with apparatus structures.

Figure 14:
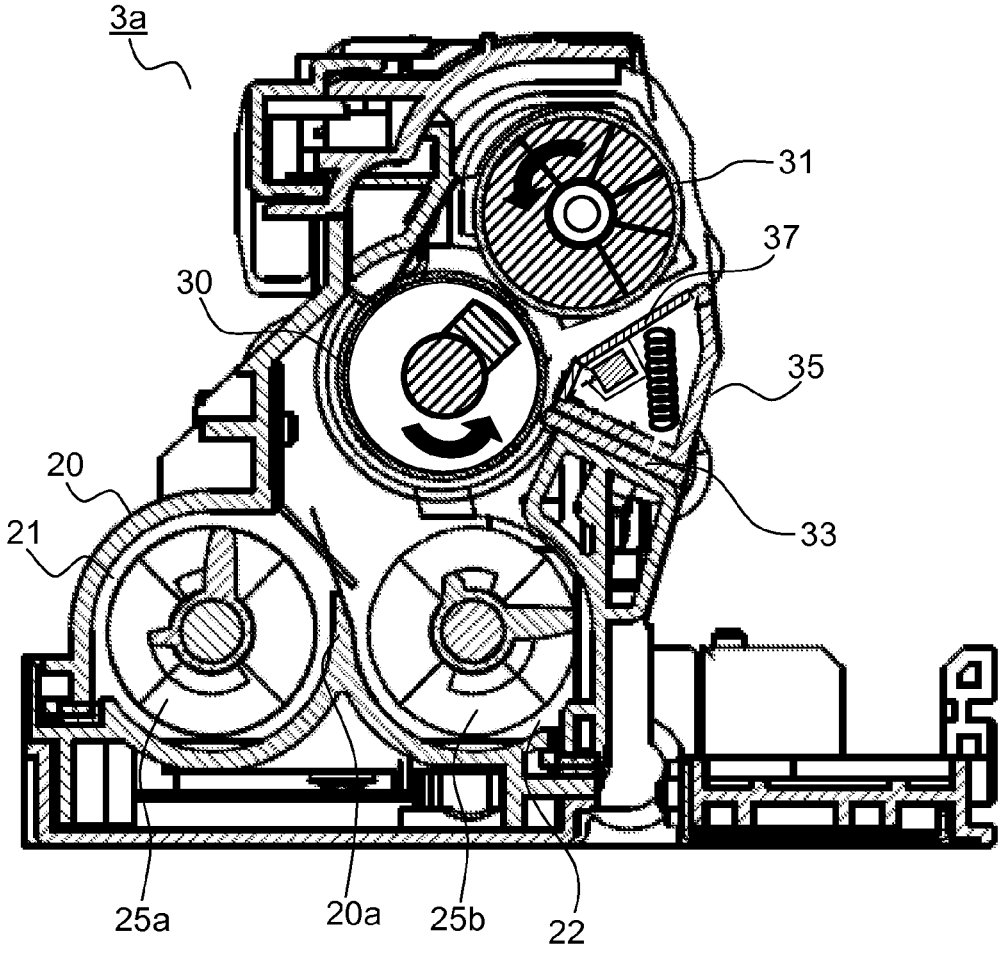
FIG. 14 is a side sectional view of the developing device 3*a* according to the present disclosure, in which a toner supplying roller 30 and a developing roller 31 are arranged in an opposite manner.

Further, in the above-mentioned embodiments, the present disclosure is applied to the developing devices 3*a* to 3*d*, in each of which a two-component developer is used, a magnetic brush is formed on the toner supplying roller 30, only toner is moved from the toner supplying roller 30 to the developing roller 31, and which supply toner from the developing rollers 31 to the photosensitive drums 1*a* to 1*d*, respectively. Alternatively, as illustrated in FIG. 14, the present disclosure is applicable to the following developing device. That is, the developing roller 31 and the toner supplying roller 30 are arranged in an opposite manner to those in the above-mentioned embodiments. Toner is supplied to the photosensitive drums 1*a* to 1*d* by the magnetic brushes formed of the two-component developers held on the surfaces of the respective developing rollers 31 (in this structure, each corresponding to a magnetic roller having the same structure as the toner supplying roller 30 of the above-mentioned embodiments), and the toner held on the surfaces of the toner supplying rollers 30 (in this structure, each having the same structure as the developing roller 31 of the above-mentioned embodiments) is supplied to the respective developing rollers 31. At the same time, surplus toner on the surfaces of the developing rollers 31 is collected using the respective toner supplying rollers 30. With this structure as well, it is possible to effectively suppress the deposition of toner dropping from the developing roller 31 on the vicinity of the regulation blade facing the toner supplying roller 30.

Further, although the tandem-type color printer 100 is exemplified in each of the above-mentioned embodiments, as a matter of course, the present disclosure is applicable to other apparatuses such as a monochrome copying machine or a color copying machine, a digital multifunction peripheral, a monochrome printer, and a facsimile.

Through application of the present disclosure, toner deposition on the vicinity of the regulation blade in the developing device can be effectively suppressed. Further, an image forming apparatus provided with the developing device effectively prevents image failures such as toner dropping derived from the toner deposition.

What is claimed is:

1. A developing device, comprising:

a developing roller arranged to face an image carrier on which an electrostatic latent image is to be formed, for supplying toner to the image carrier in a facing region with respect to the image carrier;

a toner supplying roller arranged to face the developing roller, for supplying the toner to the developing roller in a facing region with respect to the developing roller;

a regulation blade arranged to face the toner supplying roller at predetermined distance;

a casing for housing the developing roller, the toner supplying roller, and the regulation blade, the casing including a toner catching support member facing the developing roller or the toner supplying roller between the regulation blade and the image carrier;

a toner catching member arranged along a longitudinal direction of the toner catching support member, for catching toner which drops from the developing roller; and a vibration generating mechanism for vibrating the toner catching member, wherein, except during image formation, the toner catching member is vibrated by the vibration generating mechanism and the toner supplying roller is rotated in a direction reverse to a rotating direction during the image formation.

2. A developing device according to claim 1, further comprising an elastic member for supporting a toner catching surface of the toner catching member so that the toner catching member is vibrated in a direction substantially perpendicular to the toner catching support member.

3. A developing device according to claim 2, wherein the elastic member comprises a coil spring arranged substantially perpendicular to the toner catching surface.

4. A developing device according to claim 1, wherein the toner supplying roller comprises a magnetic roller for carrying a two-component developer containing toner and carrier by a plurality of magnetic poles provided therein.

5. A developing device according to claim 1, wherein the developing roller comprises a magnetic roller for carrying a two-component developer containing toner and carrier by a plurality of magnetic poles provided therein.

6. An image forming apparatus, comprising the developing device according to claim 1.

7. A developing device, comprising:

a developing roller arranged to face an image carrier on which an electrostatic latent image is to be formed, for supplying toner to the image carrier in a facing region with respect to the image carrier;

a toner supplying roller arranged to face the developing roller, for supplying the toner to the developing roller in a facing region with respect to the developing roller;

a regulation blade arranged to face the toner supplying roller at predetermined distance;

a casing for housing the developing roller, the toner supplying roller, and the regulation blade, the casing including a toner catching support member facing the developing roller or the toner supplying roller between the regulation blade and the image carrier;

a toner catching member arranged along a longitudinal direction of the toner catching support member, for catching toner which drops from the developing roller; and a vibration generating mechanism for vibrating the toner catching member, wherein the vibration generating mechanism comprises:

a vibration motor fixed to a rear surface of the toner catching member; and an oscillating weight fixed in a manner that a center of gravity of the oscillating weight is shifted with respect to an output shaft of the vibration motor;

wherein the vibration motor is fixed to the rear surface of the toner catching member so that the output shaft is substantially parallel to a longitudinal direction of the toner catching member;

the toner catching member is rockably supported with an edge on the toner supplying roller side as a fulcrum and an edge on the image carrier side as a free end; and the output shaft of the vibration motor is rotated in a direction in which an outer peripheral surface of the output shaft, which is on a side facing the toner catching member, moves from the free end side toward the fulcrum side of the toner catching member.

8. An image forming apparatus, comprising the developing device according to claim 7, wherein the vibration generating mechanism intermittently vibrates the toner catching member through repetition of turning ON/OFF the vibration motor a plurality of times.

9. A developing device, comprising:

a developing roller arranged to face an image carrier on which an electrostatic latent image is to be formed, for supplying toner to the image carrier in a facing region with respect to the image carrier;

a toner supplying roller arranged to face the developing roller, for supplying the toner to the developing roller in a facing region with respect to the developing roller;

a regulation blade arranged to face the toner supplying roller at predetermined distance;

a casing for housing the developing roller, the toner supplying roller, and the regulation blade, the casing including a toner catching support member facing the developing roller or the toner supplying roller between the regulation blade and the image carrier;

a toner catching member arranged along a longitudinal direction of the toner catching support member, for catching toner which drops from the developing roller; and a vibration generating mechanism for vibrating the toner catching member, wherein the toner catching member is bent in a mountain shape in cross-section at a bent portion parallel to the longitudinal direction of the toner catching member, partitioned into a toner catching surface above the bent portion and a toner dropping surface below the bent portion, and arranged so that the toner catching surface has a rising gradient from the toner supplying roller side to the image carrier side and the toner dropping surface below the bent portion is substantially perpendicular.

10. A developing device, comprising:

a developing roller arranged to face an image carrier on which an electrostatic latent image is to be formed, for supplying toner to the image carrier in a facing region with respect to the image carrier;

a toner supplying roller arranged to face the developing roller, for supplying the toner to the developing roller in a facing region with respect to the developing roller;

a regulation blade arranged to face the toner supplying roller at predetermined distance;

a casing for housing the developing roller, the toner supplying roller, and the regulation blade, the casing including a toner catching support member facing the developing roller or the toner supplying roller between the regulation blade and the image carrier;

a toner catching member arranged along a longitudinal direction of the toner catching support member, for catching toner which drops from the developing roller;

a vibration generating mechanism for vibrating the toner catching member; and a bias applying device for applying a bias to the toner supplying roller, wherein the toner catching member has conductivity; and the toner catching member is set to have the same potential as a potential of the toner supplying roller.

11. A developing device according to claim 10, further comprising a spring member for supporting a toner catching surface of the toner catching member so that the toner catching member is vibrated in a direction substantially perpendicular to the toner catching support member, wherein the toner catching member is electrically connected to the bias applying device through intermediation of the spring member.

12. A developing device, comprising:

a developing roller arranged to face an image carrier on which an electrostatic latent image is to be formed, for supplying toner to the image carrier in a facing region with respect to the image carrier;

a toner supplying roller arranged to face the developing roller, for supplying the toner to the developing roller in a facing region with respect to the developing roller;

a regulation blade arranged to face the toner supplying roller at predetermined distance;

a casing for housing the developing roller, the toner supplying roller, and the regulation blade, the casing including a toner catching support member facing the developing roller or the toner supplying roller between the regulation blade and the image carrier;

a toner catching member arranged along a longitudinal direction of the toner catching support member, for catching toner which drops from the developing roller;

a vibration generating mechanism for vibrating the toner catching member; and a sheet member having toner adhesiveness lower than toner adhesiveness of the toner catching member, the sheet member being bonded to a surface of the toner catching member, which is on a side facing the developing roller or the toner supplying roller, wherein the sheet member is bonded to cover a boundary between the toner catching support member and the toner catching member.

13. An image forming apparatus, comprising a developing device, comprising:

a developing roller arranged to face an image carrier on which an electrostatic latent image is to be formed, for supplying toner to the image carrier in a facing region with respect to the image carrier;

a toner supplying roller arranged to face the developing roller, for supplying the toner to the developing roller in a facing region with respect to the developing roller;

a regulation blade arranged to face the toner supplying roller at predetermined distance;

a casing for housing the developing roller, the toner supplying roller, and the regulation blade, the casing including a toner catching support member facing the developing roller or the toner supplying roller between the regulation blade and the image carrier;

a toner catching member arranged along a longitudinal direction of the toner catching support member, for catching toner which drops from the developing roller; and a vibration generating mechanism for vibrating the toner catching member, wherein the vibration generating mechanism intermittently vibrates the toner catching member through repetition of turning ON/OFF the vibration motor a plurality of times; and the vibration generating mechanism vibrates the toner catching member every time a predetermined number of sheets have been printed.

14. An image forming apparatus according to claim 13, wherein, in a case of single printing, the vibration generating mechanism vibrates the toner catching member on a smaller printed-sheet-number basis compared to a case of successive printing.

15. An image forming apparatus according to claim 14, wherein the vibration generating mechanism changes a number of printed sheets to start vibration of the toner catching member depending on conditions of temperature and humidity of inside or outside the image forming apparatus.

* * * * *